United States Patent [19]

Schulze

[11] Patent Number: 4,901,627

[45] Date of Patent: Feb. 20, 1990

[54] HYDRAULIC IDLING-REGULATING VALVE

[76] Inventor: Eckehart Schulze, Stahlbühlstrasse 36, D-7251 Weissach, Fed. Rep. of Germany

[21] Appl. No.: 192,507

[22] PCT Filed: Sep. 4, 1987

[86] PCT No.: PCT/DE87/00403

§ 371 Date: May 4, 1988

§ 102(e) Date: May 4, 1988

[87] PCT Pub. No.: WO88/01697

PCT Pub. Date: Mar. 10, 1988

[30] Foreign Application Priority Data

Sep. 4, 1986 [DE] Fed. Rep. of Germany ..... 3630176

[51] Int. Cl.[4] ..... F15P 9/10

[52] U.S. Cl. ..... 91/374; 91/376 A; 91/380

[58] Field of Search ..... 91/368, 376 A, 380, 91/382, 374

[56] References Cited

U.S. PATENT DOCUMENTS

| | | | |
|---|---|---|---|
| 2,370,137 | 2/1945 | Biggert, Jr. | 91/380 X |
| 3,315,569 | 4/1967 | Dever | 91/380 X |
| 3,797,364 | 3/1974 | Schulze | 91/380 X |
| 4,369,693 | 1/1983 | Schulze | 91/382 X |
| 4,633,759 | 1/1987 | Schulze | 91/380 X |

FOREIGN PATENT DOCUMENTS

| | | |
|---|---|---|
| 0143740 | 1/1984 | European Pat. Off. . |
| 3342239 | 11/1983 | Fed. Rep. of Germany . |
| 8301794 | 2/1983 | France . |

*Primary Examiner*—Robert E. Garrett
*Assistant Examiner*—Mark A. Williamson
*Attorney, Agent, or Firm*—Antonelli, Terry & Wands

[57] ABSTRACT

A hydraulic idling-regulating valve comprising at least two mechanically operated through-flow valves which can be controlled to move alternatively into a flow position and a closure position and which are both closed in a neutral central position. An electromechanical specified-value setting system positions the piston of a hydraulic drive cylinder, which system comprises a hollow shaft that can be rotated by a number of revolutions correlated with the specified value, and an actual-value feedback system is provided which comprises a feedback spindle which is in engagement with an internal thread of the hollow shaft and which performs a number of revolutions correlated with the piston movement. The valve-actuating element is subjected to the same displacements as the specified-value setting shaft. A casing is provided with a circular cylindrical core having a first longitudinal bore for accommodating the pistons of a pair of valves for displacement between longitudinally movable stop elements, and another bore accommodating the hollow shaft in rotatable and displaceable relationship. The stop elements are axially and radially supported at the hollow shaft by pivot pads. The casing is provided with a circular cylindrical envelope. The connection spaces on the pressure-source side and on the consumer side are delimited by external grooves in the cylindrical core, inlet and outlet ducts are defined by radial bores in the core and in the envelope.

9 Claims, 4 Drawing Sheets

HYDRAULIC IDLING-REGULATING VALVE

BACKGROUND OF THE INVENTION

The present invention relates to a hydraulic idling-regulating valve means for controlling movements of a machine element drivable by a hydraulic cylinder. The valve means includes at least two mechanically operated through-flow valves arranged in a casing and controlled, by the reciprocating movements of an actuating element, to move from a neutral central position with both valves closed into alternative directions into a flow position and closure position. An electromechanical specified-value setting system and a mechanical actual-value feedback system are provided for setting and/or controlling the specified and actual values of the instantaneous position of the pistons of the driving hydraulic cylinder. The specified-value setting system comprises a hollow shaft rotatably mounted in a housing of the valve means and reciprocable in the longitudinal direction. The hollow shaft rotates a number of revolutions correlated with the respective specified value, by electric motor provided for the purpose of controlling the specified value. The actual-value feedback device comprises a feedback spindle engageable, via an external thread, with an internal thread of the hollow shaft and which is coupled, by form-locking means, to move with a piston of the driving hydraulic cylinder either, when the connection with the piston is rigid, in such a manner that it follows any displacement of the latter or, in the case of a rotational connection with the piston, in such a manner that it performs a number of rotations correlated with the movements of the piston, in which case the valve-actuating member is subjected to the same displacements in the axial direction as the specified-value setting shaft, with the specified-value setting shaft being rotatably supported in the valve-actuating element which in turn is secured against rotation in the casing.

Idling-regulating valves of the aforementioned type have been proposed in DE-PS 20 62 134 and DE-OS 29 10 530, and are equipped with an electromechanical specified-value setting system and a mechanical actual-value feedback system for setting and/or controlling the specified and actual values of the instantaneous position of the pistons of the driving hydraulic cylinder. The specified-value setting system, which comprises a hollow shaft mounted to rotate in the housing of the valve and to reciprocate in the longitudinal direction, is rotatable a number of revolutions correlated with the respective specified value, by an electric motor provided for the purpose of controlling the specified value. The actual-value feedback system comprises a feedback spindle which, is in engagement via an external thread with an internal thread of the hollow shaft and which is movably coupled in a form-locking manner with the piston of the driving hydraulic cylinder either, when the connection with the piston is rigid, in such a manner that it follows any displacement of the latter or, in the case of a rotational connection with the piston, in such a manner that it performs a number of rotations correlated with the movements of the piston, in which case the valve-actuating member is subjected to the same displacements in the axial direction as the specified-value setting shaft, the latter being rotatably supported in the valve-actuating element which in turn is, however, secured against rotation in the casing. The casing in which the pressure tank and supply ducts leading to the individual through-flow valves as well as the consumer connection ducts leading from the valves to the controlled hydraulic cylinder are integrated, have been implemented heretofore as aluminium die-castings comprising the valve cores and bores accommodating the specified-value setting hollow shaft and the actual-value feedback spindle as well as the space for the valve-actuating element which can be described as being arranged between the valve cores and actuating the latter by a radially projecting actuating element.

However, a particular disadvantage of conventional idling-regulating valves resides in the complex structure of the casing which requires considerable space and which necessitates a very complex and expensive core for casting. In addition, the aluminium casing must be very solid if the required tightness is to be ensured against the highly pressurized working medium, i.e., a pressure fluid, with the working pressures reaching 200 bar. Accordingly, high demands must be placed upon the quality of the cast housing and it is not rare that it is found only during the final production test of the finished idling-regulating valve that the casing is porous and has, therefore, to be rejected, a process which is of course connected with additional costs.

Now, it is the object of the present invention to provide an idling-regulating valve of the type described above which can be realized with considerably smaller outer dimensions and can be produced much more easily and rationally from steel, without any sacrifices as to control accuracy and operating reliability.

This object is achieved according to the invention by an arrangement characterized in that the casing has a circular cylindrical core with at least one first longitudinal bore in which are arranged longitudinally movable pistons of a pair of valves, between stop elements which are fixed against rotation relative to the casing, but mobile in the longitudinal direction. Another bore is provided in which the hollow shaft of the specified-value setting system, which can be driven by the electric motor, is mounted in a rotatable and longitudinally movable manner. The stop elements are carried axially and radially on the specified-value setting shaft via pivot pads. The casing is further provided with a cylindrical circular envelope into which the core is firmly set, with the connection spaces on the pressure-source side and the consumer side which, depending on the position of the valve pistons are either connected to communicate with each other or closed against each other, being defined by external grooves on the cylindrical core and by inner surface areas of the envelope fixed thereto, and inlet and outlet ducts being defined by radial bores in the core and the envelope.

This solution is advantageous in that the arrangement of the stop elements of the valve-actuating element outside the valve bores reduces the required space in the radial direction so that the space required for the idling-regulating valve as a whole is notably reduced. The circular cylindrical design of the core of the valve casing and its outer envelope enables these parts to be implemented as machined steel parts which can be produced by simple operations on usual machine tools, at high precision.

It can be fitted into the bore of a machine part having a diameter corresponding to the outer diameter of the envelope of the casing, in which case the supply and consumer connections are to be provided in the housing part of the machine.

The idling-regulating valve according to the invention is suited not only for controlling linear drives, but also for controlling rotary drives designed to perform a plurality of rotations in a given sense of rotation, as well as for controlling pivot drives with limited pivot angle. When used for controlling rotary drives, particular advantages are offered by a construction; of the regulating valve where a feedback system comprises a feedback spindle which is fixed on the driven rotary or pivoting part to rotate therewith.

This last-mentioned embodiment of the idling-regulating valve according to the invention is particularly well suited for controlling hydraulic pivot drives of multi-joint industrial robots where the idling-regulating valve can be accommodated without any difficulty in the universal-joint shaft.

According to another object of the invention, the firm connection between the core and the envelope of the casing is achieved by thermal shrinking of the envelope and/or thermal expansion of the core, after the latter has been cooled down.

Another embodiment of the invention provides that, prior to being shrunk upon the core, the envelope is heated up to a temperature of 400° K., and the core is cooled down in liquid air or liquid oxygen to a temperature of substantially 150° K., preferably, by 80° K.

According to a further embodiment of the invention, the specified-value setting shaft and the bore accommodating the feedback spindle extend along the central longitudinal axis of the idling-regulating valve and at least two bores accommodating the pistons of one pair of valves each are provided in rotary symmetrical relationship relative to the central longitudinal axis.

According to still another embodiment of the invention, the envelope is provided with external annular grooves delimiting separate envelope portions, with the radial supply and consumer connection ducts ending each in one of the envelope portions, and the valve casing embracing the core and the envelope can be accommodated in a bore of an outer housing block in which separate sections are sealed against each other by sealing rings, with ducts run in the outer housing block and corresponding to the supply and consumer connections of the envelope opening into the said bore sections.

Still another embodiment of the invention provides that the pistons of each of the pairs of through-flow valves accommodated in one of the longitudinal bores of the core are supported against each other by a biased spring and the stop elements are provided with control elements for setting the positions of the valve pistons between the stop elements.

According to another embodiment of the invention, the feedback spindle is fixed to the rotary part of the pivot drive so as to rotate therewith.

Finally, one embodiment of the invention provides that it is used in drives for the joints of multi-joint robot arms.

Other details and features of the present invention will become apparent from the following description of several embodiments of the invention with reference to the accompanying drawings.

DETAILED DESCRIPTION

Figures 1, 2:
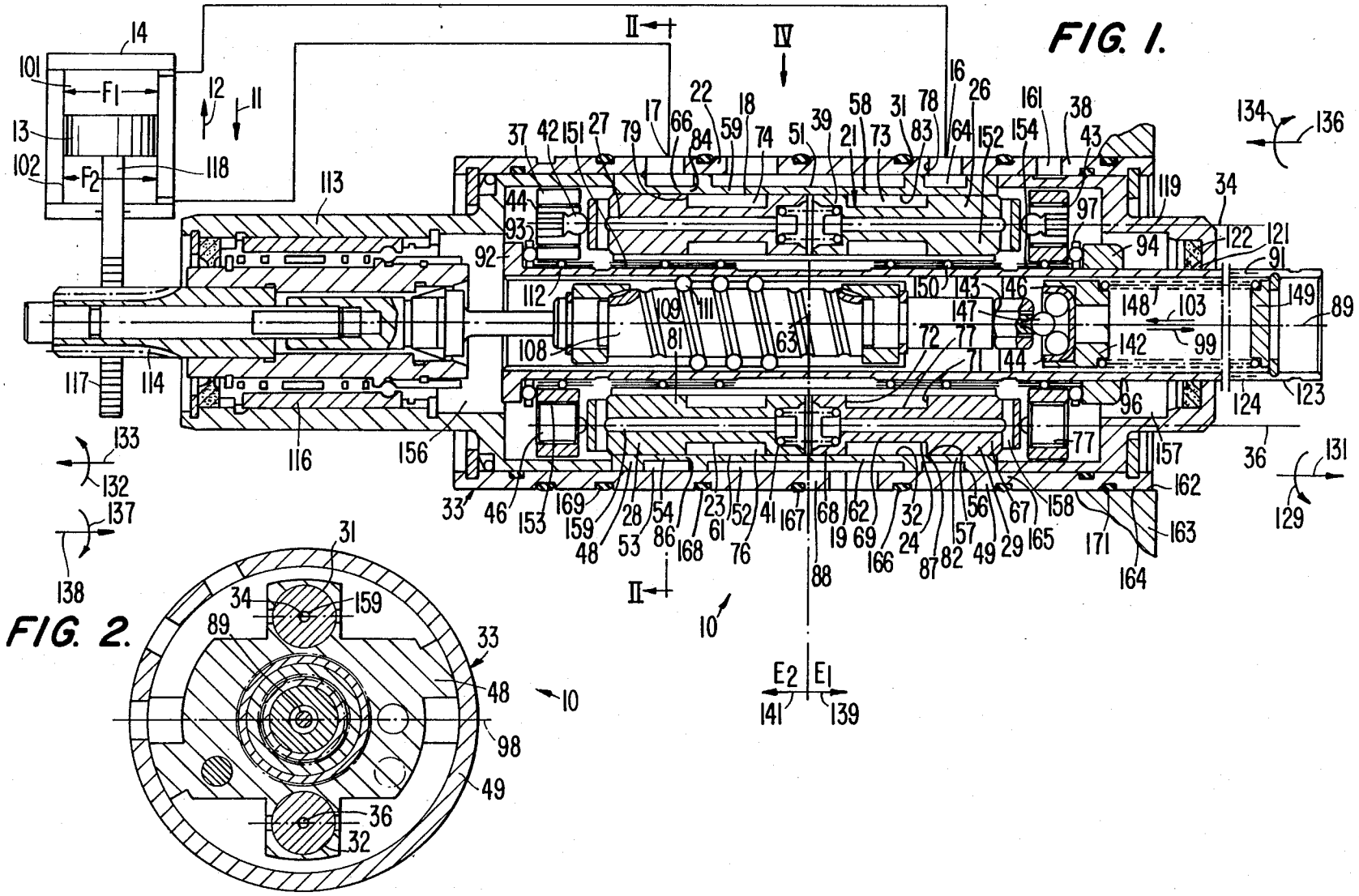
FIG. 1 is a longitudinal cross-sectional view of a first embodiment of an idling-regulating valve in accordance with the present invention having a total of four through-flow valves accommodated in bore of a cylindrical core of a housing for controlling advance and return motions of a double-acting hydraulic linear motor.
FIG. 2 is a cross-sectional view of the idle-regulating valve of FIG. 1 taken along a line II—II in FIG. 1.

Referring now to the drawings wherein like reference numerals are used throughout the various views to designate like parts and, more particularly, to FIGS. 1 and 2, according to these figures, an idling-regulating valve generally designated by the reference numeral 10, constructed as a four/three-way valve, controls an amount in speeds of an alternative advance and return movements, represented by arrows 11, 12, of a piston 13 of a double-acting hydraulic cylinder 14 and a machine element (not known) driven by the hydraulic cylinder 14. The driven machine element may, for example, be a drilling head intended for drilling a bore of a pre-determined depth into a workpiece, or a punching of pressing tool, or generally a machine element which has to perform a working stroke in a forward direction followed by a return stroke into an initial position, within one working cycle.

The idling regulating valve 10 is suited also for use on a CNC-controlled machine tool where the movements of the workpiece and the tool are superimposed in such a manner that very complex machining paths result for a single operating cycle, with the workpiece being subjected in each operating cycle to several advance and return movements with varying excursions, until it is finally returned to a position suited as initial position for the next machining cycle.

The idling-regulating valve 10 comprises valve elements which are each designed for establishing or interrupting, respectively, the communicating connection between one consumer connection bore 16 (A connection) or 17 (B connection) and one of the two supply connection bores i.e. the high-pressure connection bore (P connection) 18 or the tank connection bore (T connection) 19.

The valve elements are designed as slide valves 21, 22, 23 and 24 having pistons 26 to 29 arranged to reciprocate in two parallel longitudinal bores 31 and 32 of the valve casing generally designated by the reference numeral 33, viewed in the direction of the axes 34 or 36 of the central bores, and which are sealed relative to the bores 31 and 32.

The piston 26 of the slide valve 21 which either connects or disconnects the consumer conection bore 16 to or from the P supply connection bore 18 in its different operating positions, and the piston 27 of the slide valve 22 which either connects or disconnects the B consumer connection bore 17 to or from the P supply connection bore 18 in its different operating positions, are arranged opposite each other in the upper longitudinal bore 31 of the valve casing, as shown in FIG. 1.

The piston 28 of the slide valve 23 which in its different possible operating positions either disconnects or connects the A consumer connection bore 16 to or from the T connection bore 19, and the piston 29 of the slide valve 24, which in its two different operating positions either disconnects or connects the B consumer connection bore 17 to or from the tank connection bore 19, are arranged in the second, lower longitudinal bore 32 of the casing 33 of the idling-regulating valve 10, as shown in FIG. 1. The valve pistons 26 to 29 are mounted between stop rings 37 and 38, with one biased pressure spring 39 or 41 being arranged between each pair of pistons 26 and 27, and 28 and 29 for urging the pistons 26 and 27, or 28 and 29 into contact with stop balls 42 of the stop rings 37 and 38. The stop balls are seated in spherical cup-shaped recesses in set screws 43 and 44, and 46 and 47, respectively, by which the positions of the pistons 26, 27 and 28, 29, respectively, can be adjusted in a defined manner, individually for each of the valves 21 to 24.

The bore 31 accommodating the two valve pistons 26, 27, and the bore 32 of the valve casing 33 accomodating the two valve pistons 28 and 29, are provided in a cylindrical core 48 of the valve casing which further comprises a tubular envelope 49 which is mounted on the said core 48 by thermal shrinking to provide a rigid and pressure-tight connection.

The cylindrical core 48 and the tubular envelope 49, which preferably consist of the same steel, are produced in such a manner that the inner diameter of the tubular envelope 49 is approximately 2/100 mm smaller than the outer diameter of the cylindrical core 48 when both parts exhibit the same temperature, for example room temperature, i.e. a temperature of approximately 300° K.

Before the two parts 48 and 49 are assembled, the tubular envelope 49 is heated up to a temperature of approximately 200° C., i.e. to a temperature of 500° K., and the cylindrical core 48 is cooled down to the temperature of liquid air, namely, approximately 175° C., equalling a temperature of approximately 100° K., whereby the diameter of the tubular envelope 49 is enlarged by approximately 1/100 mm, relative to the value of, for example, 30 mm existing at room temperature, and the diameter of the cylindrical core 48 is correspondingly reduced by approximately 2/100 mm. In this condition, which is connected with drastic temperature differences between the two casing parts 48 and 49, and in which the inner diameter of the envelope 49 is larger by approx. 3/100 mm than the outer diameter of the core 48, the core 48 can be brought without any difficulty into its desired position inside the envelope 49 and retained in this position, for example, by suitable stop means. Once the two parts have once again assumed the same temperature, i.e. room temperature, an intimate and stress-free connection is obtained between the two casing parts 48, 49 which cannot be released again without destroying the envelope 49 and/or the core 48.

Due to this design of the valve casing 33 it is possible in a very simple manner to realize ducts 51 and 52 for interconnecting the P supply connection bore 18 and the T connection bore 19 by external grooves 51' and 52' (FIGS. 4*a* and 4*b*) in the core 48 of the casing 33 and the corresponding covering areas of the tubular envelope 49 which is, in turn, provided with connection bores 18 and 19. The same applies to a first duct 53 in the casing which connects the outlet 54 of the lower left valve 23, as in FIG. 1, to the A consumer connection bore 16 and which is formed by a Z-shaped groove 53' shown in FIG. 4*b*, and the areas of the envelope 49 covering the grooves, and also to the duct 56 in the casing connecting the outlet 57 of the lower right valve 24, as viewed in FIG. 1, to the B consumer connection bore 17 of the idling-regulating valve 10 which is likewise formed by a Z-shaped external groove 56' in the core 48 and the corresponding areas of the envelope 49 covering the groove 56'. The openings forming the supply inlets 58 and 59, and 61 and 62 of the valves 21 and 22 and the valves 23 and 24, respectively, are formed by radial bores in the core 48 which are provided in the grooves 51' and 52' defining the pressure duct 51 and the tank duct 52, in symmetrical arrangement relative to the transverse center plane 63 of the core 48, and which open into the longitudinal bores 31 and 32.

As shown in FIG. 1, the outlets 64 and 66 and/or 54 and 57 of the valves 21 and 22 and/or 23 and 24 may also be defined by radial bores in the core 48 in which case the outlets 64 and 54 of the upper right valve 21, as viewed in FIG. 1, or of the lower left valve 23 open into the Z-shaped duct 53, and the outlets 66 and 57 of the two other valves 22 and 24 open into the other Z-shaped duct 56 in the casing 48, 49. Let it be initially presumed for the purposes of the present explanations that the valve outlets 64, 66, 54 and 57 are constructed in this manner and another construction of these valve outlets will be described below in connection with FIGS. 2, 4*a* and 4*b*.

The pistons 26 to 29 of the slide valves 21 to 24 are all of identical construction, as shown in FIG. 1, with each of the pistons 26 to 29 comprising a first outer piston flange 67 projecting from the respective bore 31 or 32 and a second, inner piston flange 68, and with the two flanges 67, 68 being interconnected by a piston rod 69 of smaller diameter. The inner annular end faces 71, 72 of the piston flanges 67, 68 delimit, in an axial direction, annular spaces 73, 74, and 76, 77 of the valves 21, 22, and 23, 24, which annular spaces 73, 74, and 76, 77 communicate constantly with the P supply connection bore 18 and/or the tank connection 19 in the different possible positions of the pistons 26 to 29.

In the position of the pistons 26 to 29 shown in the drawing, namely the symmetrical position relative to the transverse center plane 63 of the casing 33 of the valve 10, the valve occupies its initial position 0 in which the described annular spaces 73, 74, and 76, 77 are closed against the consumer connection bores 16, 17, which means that control edges 78, 79, and 81, 82 formed by outer peripheral areas of the outer edges of the inner annular end faces 72 of the outer piston flanges 67 are in positive overlapping engagement with control edges 83, 84, and 86, 87 formed on the casing and defining the innermost edges of the valve outlets 64, 66, and 54, 57 of the valves 21, 22, and 23, 24, viewed from the transverse central plane 63 of the casing. In this context, the term "positive overlapping engagement" is to be understood as the, short distance by which one of the valve pistons must be displaced relative to its illustrated initial position until its annular space comes to communicate with the respective valve outlet. Correspondingly, the term "negative overlapping engagement" between two control edges is to be understood as the axial clear distance between these control edges obtained when the respective annular space of the valve communicates with the respective valve outlet.

The core 48 of the casing 33 of the valve 10 is provided with a central longitudinal bore 88 extending along the central longitudinal axis 89 of the valve casing 33.

The central longitudinal bore 88 accommodates a hollow shaft 91 which is seated therein for rotatable and for reciprocatory movement in the axial direction. The central longitudinal bore 88 passes fully through the core 48 of the casing 33 and carries on its one end, the left end in FIG. 1, projecting from the core 48 a radial flange 92 supporting the one annular stop flange 37 in the axial direction via a thrust ball bearing 93 so that the hollow shaft 91 is permitted to rotate with little friction relative to the stop ring 37. A flange ring 94 fitted on the hollow shaft 91, at its end opposite the radial flange 92, is secured against axial displacement towards the outside, i.e. towards the left in FIG. 1, by a retaining ring 96. The hollow shaft 91 is supported and rotatably seated on the stop ring 38 in the axial direction by a ball bearing 97 corresponding, from the functional point of view, to the thrust ball bearing 93 and arranged between the said flange ring 94 and the right stop ring 38.

Figure 3:
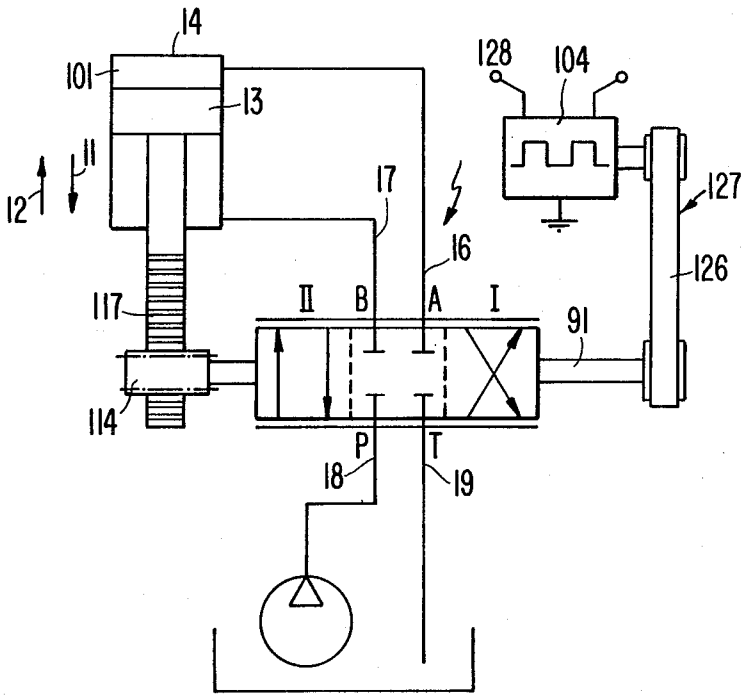
FIG. 3 is a schematic view of the idle-regulating valve of FIG. 1.

The axial spacing between the radial flange 92 of the hollow shaft 91 and the flange ring 94 is selected in such a manner that when the set screws 43, 44 and 46, 47 of the stop rings 37, 38 occupy a medium position, the pistons 21, 22, 23, 24 occupy positions in which the axial spacing between their control edges 78, 79, and 81, 82 have the same axial distance relative to each other as the corresponding control edges 83, 84 and 86, 87 of the core 48 of the casing 33. The pistons 21, 22, and 23, 24 should in this case also be adjusted in such a manner by the set screws 43, and 44, and 46, 47—that they are arranged symmetrically relative to the longitudinal center plane 98 of the piston arrangement 21, 22, 23, 24 extending between the longitudinal bores 31, 32. If with this setting of the pistons 21 to 24 the hollow shaft 91 is advanced into the position in which the transverse center plane 63' of the piston arrangement 21, 22, 23, 24 coincides with the transverse center plane 63 of the core 48 of the casing 33, then all valves 21 to 24 are in their closed position corresponding to the initial position of the idling-regulating valve 10 designated by 0 in FIG. 3. When the hollow shaft 91 and, consequently, also the pistons 26 to 29 of the valves 21 to 24 are displaced in the direction indicated by arrow 99, i.e. to the right in FIG. 1, the idling-regulating valve is transferred into the first flow position designated by I in FIG. 3, in which a negative overlapping is obtained between the control edges 78 and 82 of the pistons 26 and 29 of the "right" valves 21 and 24 and the corresponding control edges 83 and 87 of the core 48 of the valve casing 33, while a positive overlapping is obtained between the control edges 79 and 81 of the pistons 27 and 28 of the "left" valves 22 and 23 of the idling-regulating valve 10 and the corresponding control edges 84 and 86. In this position I of the idling-regulating valve 10, the upper working space 101 of the hydraulic drive cylinder 14, as viewed in FIG. 1, communicates with the P supply connection bore 18, while the lower working space 102, as viewed in FIG. 1, of the hydraulic drive cylinder 14 communicates with the tank connection bore 19 of the idling-regulating valve 10, which means that the working space 101 exhibiting the larger cross-sectional area $F_1$ is subjected to the high output pressure of the supply pressure source, while the working space 102 of the hydraulic cylinder 14 exhibiting the smaller, annular cross-sectional area $F_2$ is pressure-relieved so that the piston 13 of the hydraulic cylinder 14 moves in the direction indicated by arrow 11, downwardly in FIG. 1, and the hydraulic cylinder 14 performs its advance movement relative to a workpiece to be worked. When the hollow shaft 91 is displaced from the initial position 0 of the idling-regulating valve 10 in the direction indicated by arrow 103, towards the left in FIG. 1, the idling-regulating valve is transferred to its second flow position designated by II in FIG. 3, in which a negative overlapping is obtained between the control edges 79 and 81 of the pistons 27 and 28 of the "left" valves 22 and 23 of the idling-regulating valve 10 and the corresponding control edges 84 and 86 of the core 48 of the casing 33, while a positive overlapping is obtained between the control edges 78 and 82 of the pistons 26 and 29 of the "right" valves 21 and 24 and the corresponding control edges 83 and 87, in the manner described herein above.

In this position II of the idling-regulating valve 10, the lower working space 102 of the hydraulic cylinder 14 is subjected to the high output pressure of the supply pressure source, while the upper working space 101 is pressure-relieved, which means that the piston 13 of the hydraulic cylinder 14 moves in the direction indicated by arrow 12, i.e. upwardly in FIG. 1, and the hydraulic cylinder 14 performs a return movement.

The excursions of the valve pistons 21 to 24 necessary to control the hydraulic drive cylinder 14 appropriately are obtained by the interaction between the hollow shaft 91 which can be driven by a pulse-controlled electric stepping motor 104 in alternative directions of rotation indicated by arrows 129 and 134, and a threaded spindle 108 entering the hollow shaft from the one side, the left side in FIG. 1, and provided with an external thread 109 which is in form-locking engagement via balls 111 with a corresponding inner thread 112 of the hollow shaft 91.

On the casing side, the threaded spindle 108 is seated in a substantially cup-shaped end portion 113 of the casing where it is secured against axial displacement. A pinion 114 projecting through the face of the end portion of the casing is connected via coupling element 116 with the threaded spindle 108 so as to rotate therewith and is in engagement with a toothed rack 117 fixed to the piston rod 118 of the piston 13 of the drive cylinder 14 so that it performs the same movements as the latter.

The opposite side of the casing 33 is likewise closed by a substantially cup-shaped end portion 119 provided with a central opening 121 which is passed by the hollow shaft 91, with the gap between the hollow shaft 91 and the bottom opening 121 being sealed by a lip seal 122 permitting easy rotation of the hollow shaft 91.

The free end portion 123 of the hollow shaft 91 projecting from the end portion 119 of the casing, i.e. the right shaft end in FIG. 1, carries an outer toothing 124 engaging a toothed belt 126 of a belt drive generally designated by the reference numeral 127 and providing a form-locking connection between the hollow shaft 91 and the stepping motor 104.

The pulse-controlled stepping motor 104, the belt drive 127 coupling the stepping motor 104 to the hollow shaft 91, and the elements of the idling-regulating valve which are displaced together with the hollow shaft 91 constitute the functional elements of a specified-value setting system by which the stroke and the speed of the movements of the piston 13 of the hydraulic drive cylinder 14 can be controlled. The rack-and-pinion gear which comprises the pinion 114 of the threaded spindle 108 and the toothed rack 117 connected with the piston 13, and which serves to translate the piston movements in the directions indicated by arrows 11 and 12 into a correlated number of revolutions of the threaded spindle 108, constitute the functional elements of a form-locking mechanical-feedback system whose interaction with the specified-value setting means will now be described in greater detail. For the purposes of this description only, and without limiting the generality of these explanations, it wil be assumed hereafter that the idling-regulating valve assumes initially its initial position 0.

Stating out from this position, the hollow shaft 91 is now rotated, by a control pulse supplied to the one control input 128 of the stepping motor 104, by a defined angular amount of, say, 4° at a time in the direction of the arrow 129, i.e. in counter-clockwise direction, viewed from the right. The axial displacement of the hollow shaft 91, relative to the threaded spindle 108 which for the present purposes is assumed to be stationary, in the direction of arrow 131, given the illustrated orientation of the threads 109, 112 of the threaded spindle 108 and the hollow shaft 91, respectively, then causes the idling-regulating valve 10 to be moved into its flow position I in which the flow path leading from the P supply connection bore 18 via the through-flow valve 21 to the A consumer connection bore 16 and from there to the upper working space 116 of the hydraulic cylinder 14, as well as the path leading from the lower working space 102 of the hydraulic cylinder 14 via the duct 56 in the casing and the through-flow valve 24 to the tank connection bore 19 are opened while the flow paths through the two other valves 22 and 23 are blocked. Consequently, the larger surface $F_1$ of the piston 13 of the hydraulic cylinder 14 is subjected to high pressure, while its smaller surface $F_2$ is pressure-relieved.

The piston 13, therefore, moves in the direction indicated by arrow 11 in FIG. 1, whereby the threaded spindle 108 is driven to rotate in the direction indicated by arrow 132 in FIG. 1, i.e. in a direction opposite to the sense of rotation 29 of the hollow shaft 91, so that, due to the engagement between the threads of the spindle 108 and of the hollow shaft 91, a pulling force is exerted upon the hollow shaft in the direction of the arrow 133 in FIG. 1 which tends to urge the hollow shaft 91 and the valve pistons 26 to 29 moving therewith back into their initial position 0. This initial position 0, the closed position of the idling-regulating valve 10, is reached, and the movement of the piston 13 of the hydraulic cylinder 14 ends, if and when the piston 13 has performed a stroke which considering the translation ratio of the pinion-and-rack gear 117, 114 and the toothed-belt gear 127, is clearly correlated with the number of revolutions of the hollow shaft 91 that can be controlled by the stepping motor 104 so that it is ensured that when the idling-regulating valve 10 assumes again its initial position 0 the hydraulic cylinder 14 has performed a stroke corresponding exactly to a selected initial value.

When, on the other hand, the hollow shaft 91 is driven by the specified-value setting system 104 in the direction indicated by the arrow 134, i.e. in clockwise direction, the hollow shaft 91 and the elements moving therewith are displaced in the direction indicated by arrow 136, and the idling-regulating valve 10 is transferred from its initial position 0 to its flow position II linked with the "upward" movement of the piston 13 in the direction indicated by arrow 12 in FIG. 1, so that now the threaded spindle 108 is rotated in the direction indicated by arrow 137 and a pushing force acting in the direction of arrow 138 in FIG. 1 is exerted upon the hollow shaft 91 which tends to urge the pistons 26 to 29 of the idling-regulating valve 10 back into their initial position.

Stationary states of movement of the piston 13 in the direction of arrows 11 and 12 are correlated with constant excursions $\epsilon 1$ und $\epsilon 2$ in the direction indicated by arrows 139 and 141, respectively, and constant excursions $\epsilon 1$ and $\epsilon 2$, respectively, are correlated with equal angular speeds of the hollow shaft 91 and the threaded spindle 101—in the same direction of rotation 134, 132, and 129, 137, respectively. The principle of electric setting of the initial value and mechanical feedback of the actual value described above is used also in conventional idling-regulating valves, but has been described once more in a summary manner with a view to facilitating the understanding of the idling-regulating valve 10 according to the invention, and also for the sake of completeness.

It is, however, understood that an idling-regulating valve 10 according to the invention may also be implemented in such a manner that the threaded spindle 108 is connected rigidly with the piston rod 118 of the piston 13 of the hydraulic cylinder 14, in which case the hollow shaft 91 must then have an internal thread 112 sufficiently "long" to permit relative movements between the hollow shaft 91 and the threaded spindle 108 corresponding to the stroke of the piston 13. This method of feeding back the actual value is also known from conventional idling-regulating valves and may be transferred to the idling-regulating valve 10 according to the invention.

In the case of the embodiment illustrated in the drawings a ram 142 is arranged inside the hollow shaft for axial movement. The ram 142 carries on its end facing the inner end 143 of the threaded spindle 108 a ball-bearing cage 144 including rotatable balls 146 which serve as support, by point contact, for a spherical thrust piece 147 of the threaded spindle 108. A biased pressure spring 148 extending between the movable ram 142 and a thrust piece 149 sealing the hollow shaft 91 against the outside urges the ram 142 and its ball bearings 146 constantly against the thrust piece 147 of the threaded spindle 108 whereby a constant minimum torque is applied by which, finally, play-free engagement of the functional elements of the specified-value setting means and the actual-value feedback means and, consequently, optimum sensitivity of the regulating system is obtained. In order to keep the frictional forces between the hollow shaft 91 and the wall of the central bore 88 in the core 48 of the casing 33, and between the hollow shaft and the stop rings 37 and 38 at the lowest possible level, these parts are in contact with each other via balls 150 running freely in cylindrical cages 151 and 152, 153 and 154.

The inner space 156 of the casing, which is delimited against the outside by the end portion 113 and which communicates with the inner space of the hollow shaft 91, and the inner space 157 of the casing which is delimited towards the outside by the right end portion 119 are interconnected by means of transverse bores 158 and longitudinal bores 159 in the valve pistons 26 to 29 so that only one discharge duct 161 is required in the casing 33 for carrying off possible leakage oil.

As schematically indicated in FIG. 1, the idling-regulating valve 10 is suited for being accommodated in a bore 162 of a machine-housing part 163 which must be provided in this case with supply and consumer connection bores corresponding to the arrangement of the P and T supply connection ducts 18 and 19 and/or to the arrangement of the consumer connection bores 16 and 17 and the leakage-oil discharge duct 161 in the casing 33 of the idling-regulating valve 10 and communicating, in the envisaged installed position of the idling-regulating valve 10 with corresponding supply and consumer connection bores 18, 19 and/or 16, 17 of the valve 10. For sealing the corresponding supply and consumer connection bores and ducts in the housing part 163 of the machine and in the valve casing 33, the tubular envelope 49 of the valve casing 33 is provided with outer annular grooves 164 to 169 accommodating 0 rings 171 sealing the casing 33 against the bore 162. The 0 rings 171 are provided in paris with each pair sealing one of the annular envelope areas within which the associated supply and consumer connection bores and the corresponding connections of the housing portion 163 of the machine open into the bore 162.

Figure 4A:
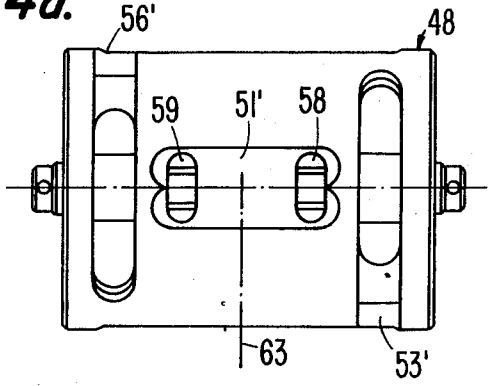
FIG. 4*a* is a schematic representation of a core of the valve casing of the idling-regulating valve of the present invention, as viewed in a direction of an arrow IV in FIG. 1.
Figure 4B:
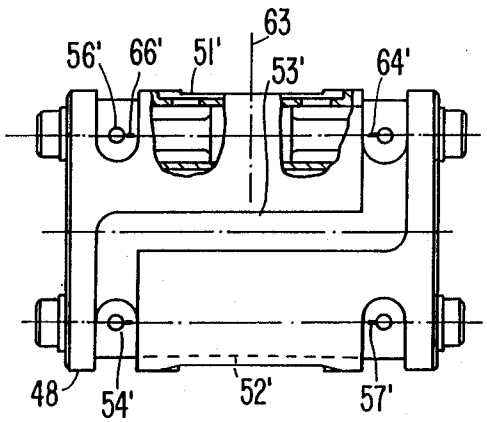
FIG. 4*b* is a schematic representation of the core of FIG. 4*a*, as viewed perpendicularly to a plane of FIG. 1.

With special construction of the core 48 of the valve casing 33 illustrated in FIGS. 4*a* and 4*b* the ducts 64' and 66', 54' and 57' which are closed in the initial position 0 of the idling-regulating valve 10 or alternatively opened in other positions and which in the open position of the respective valve 21, 22, or 23, 24 connect the annular spaces 73 and 74, or 76 and 77 alternatively with one of the two consumer connection bores 16 and 17, or with the tank connection bore 19, are not constructed as radial bores but rather as "horizontal" slots 64' and 66' or 54' and 57' exhibiting a constant clear width in the direction of displacement of the pistons 26, 27, or 28 and 29 of the valves 21 to 24 so that flow cross-sections of the valves 21, 22, and 23, 24, varying in proportion to the excursions of the pistons 26, 27 or 28, 29, are obtained.

Another embodiment of an idling-regulating valve 10 will now be described with reference to FIG. 5. This embodiment comprises a hydraulic pivot drive with controlled and/or regulated idling motion generally designated by the reference numeral 172 whose idling-regulating valve 10' is absolutely analogous with regard to function, related to the control of the pivot drive 172 to the function of the idling-regulating valve 10 of FIG. 1 which is designed for controlling a hydraulic linear motor 14. With regard to the structure of the idling-regulating valve 10' according to FIG. 5, this also largely corresponds to the idling-regulating valve 10 described with reference to FIGS. 1 to 4 *b*.

The idling-regulating valve 10' comprises a cylindrical core 48 and a tubular envelope 49 of a construction and function identical to those of the idling-regulating valve 10 illustrated in FIG. 1. the same applies to the design and function of the hollow shaft 91 which is coupled in driving relationship to the stepping motor 104 via the belt drive 127 and which is utilized in the present case for setting the initial value of the pivoting arm generally designated by the reference numeral 173 of the pivot drive 172. The mutual engagement between the internal thread 112 of the hollow shaft 91 and the external thread 109 of the threaded spindle 108 provided for feeding back the actual position-indicating value, via balls 111, is also implemented in the same manner as in the case of the idling-regulating valve 10 illustrated in FIG. 1.

Figure 5:
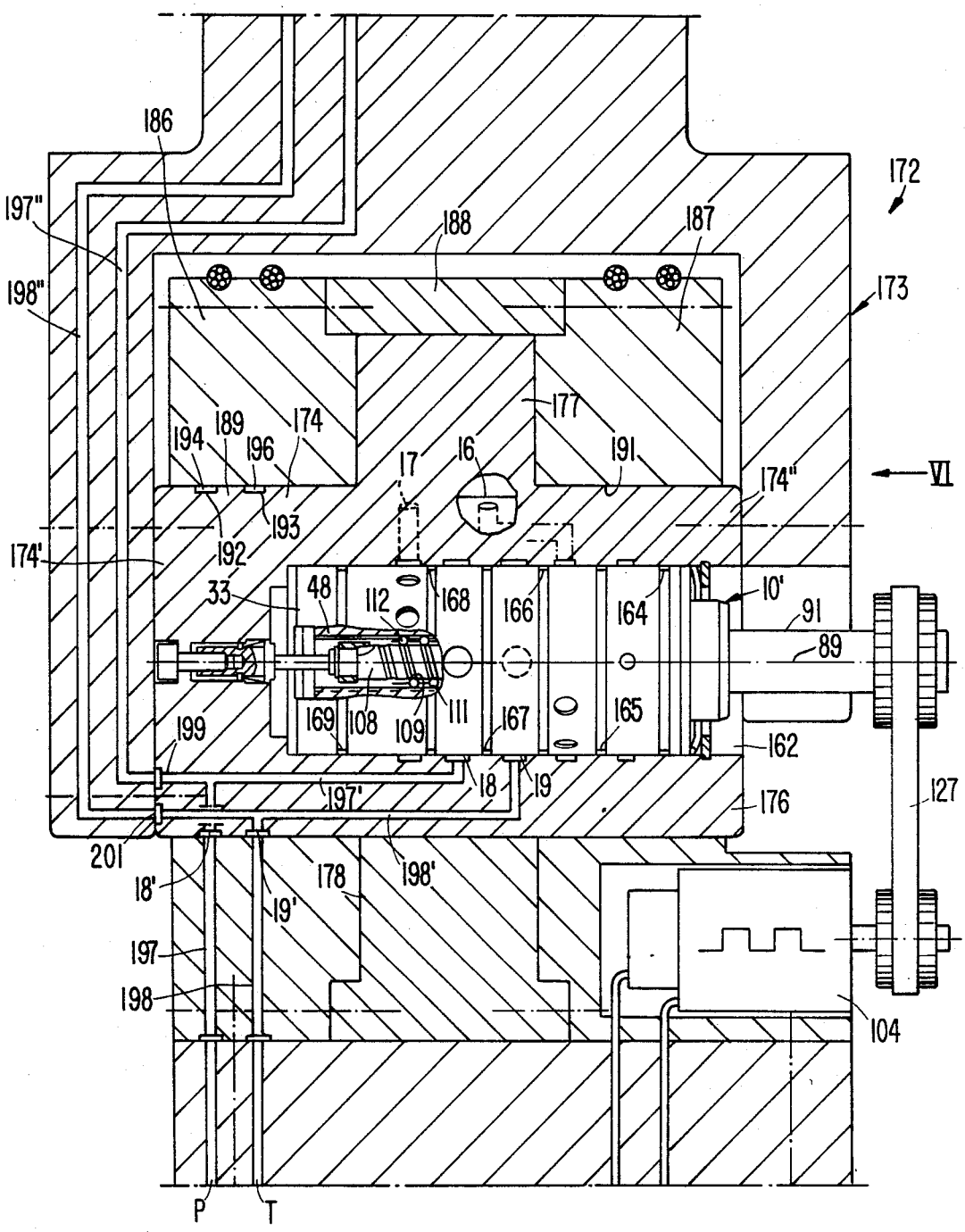
FIG. 5 is a longitudinal cross-sectional view corresponding to FIG. 1 of another embodiment of an idling-regulating valve according to the present invention for controlling a hydraulic pivot drive of a rotary drive.
Figure 6:
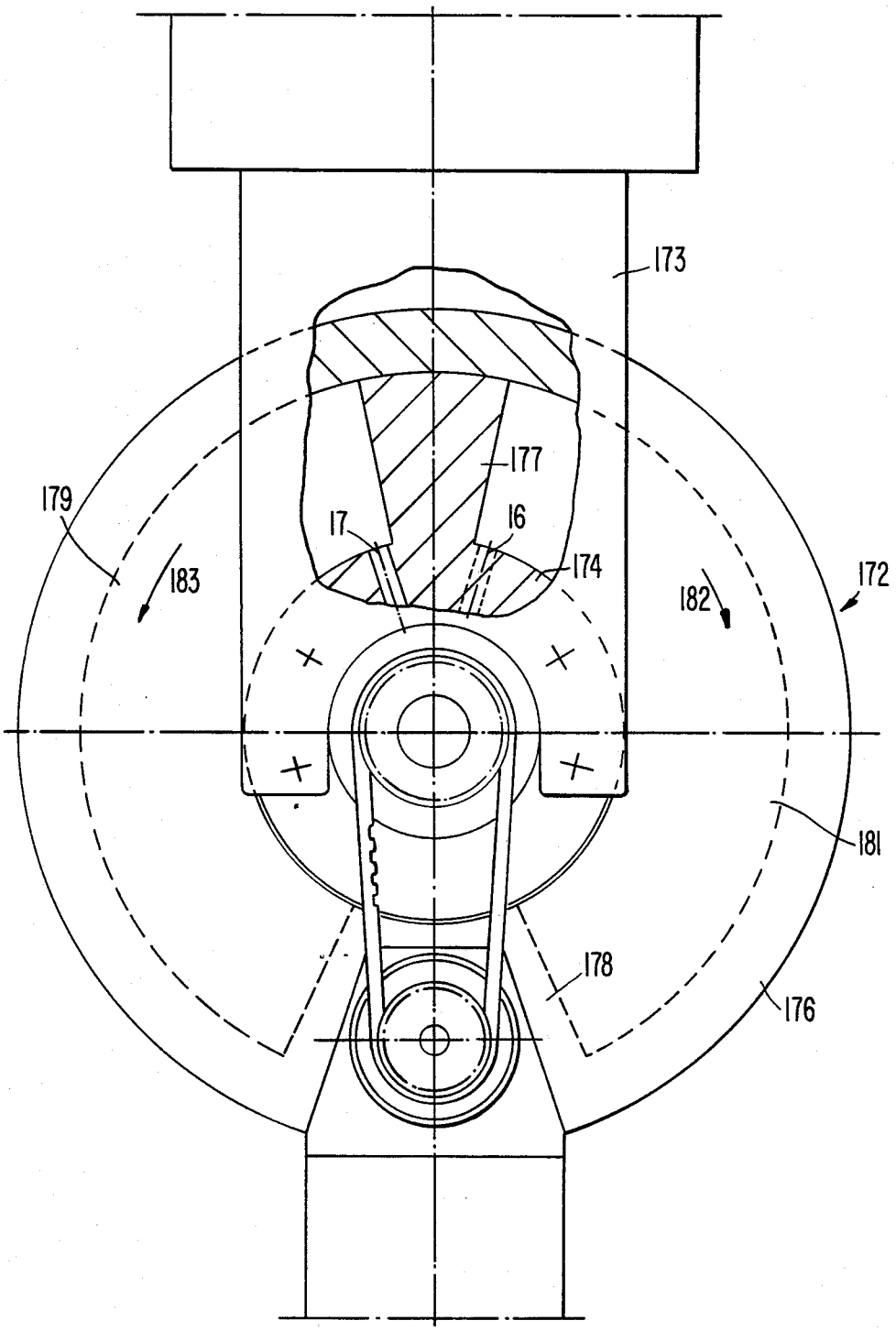
FIG. 6 is a simplified schematic view of a pivot drive of FIG. 5, as viewed in a direction of an arrow VI in FIG. 5.

The only differences between the valve 10 and the idling-regulating valve 10' according to FIG. 5 consists in the special type of actual position-value feedback which is effected in the case of the idling-regulating valve 10' by causing the feedback spindle 108 to perform the same rotary movements about the central longitudinal axis 89 of the idling-regulating valve 10', which also constitutes the pivot axis of the pivoting arm 173, as the latter, and in the fact that the feedback spindle 108 is fixed for this purpose to the shaft 174 of the pivot drive 173, which takes the form of a rotary-piston hydraulic cylinder, so as to rotate therewith.

The housing 176 of the hydraulic pivot drive 172, which for the purposes of the present explanation is assumed to be stationary, is subdivided by a rotary vane 177 of substantially sector-shaped cross-section and a radial partition wall 178 of likewise sector-shaped cross-section into two working spaces 179 and 181. By connecting these working spaces alternatively to the high-pressure supply connection bore 18' (P connection) or the tank connection bore 19' (T conection) of the supply pressure source, the rotary vane 177 can be driven in the direction indicated by the two arrows 182 and 183, respectively, which rotary movements are followed by the pivot arm 173 which is fixed to the rotary vane 177 to rotate therewith. The shaft 174 of the rotary vane 177 is supported in solid end plates 186 and 187, for rotary movement about its longitudinal axis 89. A cylindrical housing part extending between the end plates 186 and 187 and firmly connected to the radial partition wall 187 is designated by reference numeral 188. The shaft 174 of the rotary vane 177 is supported, in pressure-tight and rotary relationship, in the aligned bearing bores 189, 191 of the end walls 186, 187 of the housing. The pivoting arm 173 is mounted on free end portions 174', 174'' of the shaft 174 of the rotary vane 177 projecting from both sides of the housing 176, so as to rotate therewith. The shaft 174 of the pivot drive 172 is constructed as a hollow shaft which accommodates the idling-regulating valve 10' in its central bore 162. The tubular casing portion 33 of the regulating valve 10' is firmly mounted in the hollow shaft 174 so that the casing portion 33, and consequently also the idling-regulating valve 10' altogether, rotate together with the hollow shaft 174 and/or the pivoting arm 173 of the pivot drive 172.

The portion 174' of the shaft 174, by which the latter is seated in the bore 189 of the left end wall 186, as shown in FIG. 5, is provided with two outer annular grooves 192 and 193 defining annular spaces 194, 196, respectively, which are delimited radially to the outside by the wall of the bore 191 and which communicate with supply connection ducts 197, 198 arranged on the housing side and arriving from the P high-pressure outlet of the supply pressure source or the tank T.

The annular spaces 194 and 196 are connected to the supply connection bore 18 and 19 of the idling-regulating valve 10' via connection ducts 197' and 198' which extend through the shaft 174 of the pivot drive 172 in the manner apparent from FIG. 5, and the consumer connection bores 16, 17 of the idling-regulating valve 10' open into the working spaces 179 and 181 of the pivot drive 172 on both sides of the rotary vane 177. The described connection ducts communicate with annular grooves 99 and 201 provided on the end face of the left end portion 144' of the shaft 174, which, in turn, communicate with supply ducts 197" and 198" of the pivoting arm 173 which may be utilized for supplying another pivot drive which is arranged at the remote end, not shown in FIG. 5, of the pivoting arm 173 and which forms the other joint of a pivoting arm of a robot which is implemented in a simple manner by means of several pivot drives 172 of the type illustrated in FIG. 5.

It is understood that the idling-regulating valve 10' with the actual-value feedback system described with reference to FIG. 5 is also suited for controlling hydraulic rotary drives capable of performing several successive rotations by 360°, viewed in a given direction of rotation.

I claim:

1. The hydraulic idling-regulating valve means for controlling movements of a machine element drivable by a driving hydraulic cylinder means, the hydraulic idling-regulating valve means comprising at least one pair of mechanically operated through-flow valves arranged in a casing means and controllable by reciprocating movements of a valve actuating element to move from a neutral central position in which both valves are closed into alternative directions into a flow position and a closure position, an electromechanical specified-value setting system and a mechanical actual-value feedback system for at least one of setting and controlling specified and actual values of an instantaneous position of the pistons of the driving hydraulic cylinder means, the specified-value setting system comprising a hollow shaft rotatably mounted in a housing of the valve means and reciprocable in a longitudinal direction, said hollow shaft being rotatable through a number of revolutions correlated with the respective specified value by an electric motor provided for the purpose of controlling the specified value, said actual-value feedback device comprising a feedback spindle engageable through an external thread, with an internal thread of the hollow shaft and coupled by form-locking means to move with the piston of the driving hydraulic cylinder means either, when a connection with the piston is rigid, in a manner that the feedback spindle follows any displacement of the piston or, in the case of a rotational connection with the piston, in a manner that the feedback spindle performs a number of revolutions correlated with the movements of the piston, in which case the valve-actuating elements are subjected to the same displacements in the axial direction as the hollow shaft, the hollow shaft being rotatably supported in the value-actuating element which is secured against rotation in the casing, said casing includes a circular cylindrical core with at least one first longitudinal bore and/or in which the longitudinally movable pistons of the at least one pair of throughflow valves are longitudinally movable between stop elements fixed against rotation relative to the casing means, movable in the longitudinal direction, and another bore in which the hollow shaft of the specified-value setting system is mounted, said stop elements being carried axially and radially on said hollow shaft through pivot pads, said casing means further comprising a cylindrical circular envelope into which the circular cylindrical core is firmly set, connections spaces on a pressure-source side and a consumer side which, depending upon a position of the valve pistons are either connected to communicate with each other or are closed with respect to each other, said connection spaces being defined by external grooves on the circular cylindrical core and by inner surface areas of the envelope fixed thereto, and wherein inlet and outlet ducts are defined by radial bores in the circular cylindrical core and the cylindrical circular envelope.

2. Hydraulic idling-regulating valve according to claim 1, wherein a firm connection between said circular cylindrical core and said cylindrical circular envelope of the casing means is achieved by at least one of a thermal shrinking of said cylindrical circular envelope and thermal expansion of said circular cylindrical core, after the circular cylindrical core has been cooled down.

3. Idling-regulating valve according to claim 2, wherein said envelope is heated up to a temperature of 400° K. prior to being shrunk upon said circular cylindrical core, and said circular cylindrical core is cooled down in at least one of liquid air and liquid oxygen to a temperature of substantially 150° K.

4. Idling-regulating valve according to one of claims 1, 2, or 3, wherein said hollow shaft and a bore accommodating the feedback spindle extend along a central longitudinal axis of the idling-regulating valve means, and wherein at least two bores accommodate the pistons of said at least one pair of valves, each of said at least two bores are provided in a rotary symmetrical relationship relative to said central longitudinal axis.

5. Idling-regulating valve according to one of 1, 2 or 3, wherein said cylindrical circular envelope is provided with external annular grooves delimiting separate envelope portions, with radial supply and consumer connection ducts ending each in one of said separate envelope portions, and wherein the valve casing means embracing said circular cylindrical core and said cylindrical circular envelope can be accommodated in a bore of an outer housing block in which separate sections are sealed against each other by sealing rings, with ducts running in said outer housing block and corresponding to supply and consumer connection ducts of the cylindrical circular envelope.

6. Idling-regulating valve according to one of claims 1, 2 or 3, wherein the pistons of each of said at least one pair of through-flow valves are supported against each other by a biased spring, and wherein said stop elements are provided with control means for setting positions of the valve pistons being said stop elements.

7. Idling-regulating valve according to one of claims 1, 2 or 3, for a pivot drive, wherein the feedback spindle is fixed to a rotary part of the pivot drive so as to rotate therewith.

8. Idling-regulating valve according to claim 7, wherein the pivot drive is a drive for joints of multi-joint robot arms.

9. Idling-regulating valve according to claim 8, wherein the core is cooled down to 80° K.

* * * * *